US005515568A

United States Patent [19]

Larson et al.

[11] Patent Number: 5,515,568

[45] Date of Patent: May 14, 1996

[54] SCRUBBING MACHINE HAVING OFFSET CYLINDRICAL BRUSHES

[75] Inventors: Warren L. Larson, Maple Grove; Michael L. Blehert, Crystal; Robert A. Geyer, Champlin; Michael S. Wilmo, Crystal, all of Minn.

[73] Assignee: Tennant Company, Minneapolis, Minn.

[21] Appl. No.: 317,176

[22] Filed: Oct. 3, 1994

[51] Int. Cl.[6] ..... A47L 11/29; A46B 9/02

[52] U.S. Cl. ..... 15/50.3; 15/52.1; 15/82; 15/179; 15/182; 15/320; 15/384

[58] Field of Search ..... 15/50.3, 52.1, 15/79.2, 82, 83, 179, 182, 183, 320, 340.4, 384, DIG. 5, DIG. 6

[56] References Cited

U.S. PATENT DOCUMENTS

| | | | |
|---|---|---|---|
| 853,525 | 5/1907 | Stewart | 15/50.3 |
| 1,386,820 | 8/1921 | Watkins | 15/52.1 |
| 1,417,768 | 5/1922 | Radimak | 15/320 |
| 1,447,382 | 3/1923 | Green | 15/50.3 |
| 2,459,007 | 1/1949 | Taylor | 15/182 |
| 2,651,803 | 9/1953 | Browne | 15/52.1 |
| 3,114,922 | 12/1963 | Ballantyne | 15/50.3 |
| 3,186,019 | 6/1965 | Hattori | 15/DIG. 6 |
| 3,942,218 | 3/1976 | Krier | 15/50.3 |
| 4,670,929 | 6/1987 | Hanna | 15/179 |

FOREIGN PATENT DOCUMENTS

| | | | |
|---|---|---|---|
| 509435 | 10/1930 | Germany | 15/52.1 |
| 135999 | 12/1929 | Switzerland | 15/52.1 |
| 0598602 | 3/1978 | U.S.S.R. | 15/179 |

*Primary Examiner*—Timothy F. Simone
*Assistant Examiner*—Randall E. Chin
*Attorney, Agent, or Firm*—Dorn, McEachran, Jambor & Keating

[57] ABSTRACT

A floor scrubbing machine uses two parallel cylindrical scrub brushes. Each brush is rotated by a separate drive means, and these are at opposite ends of the brushes. This balances the weight of the drives so the brushes exert a uniform pressure on the floor. The brushes are axially offset enough that each brush extends out as far as the drive means of the other brush, thus permitting the machine to scrub close to a wall on either side. The brushes have a more aggressive bristle fill at their ends which extend out under the drive means, where only one brush is scrubbing the floor, so the appearance of the scrubbed floor is essentially the same where scrubbed by one brush as where scrubbed by two brushes.

10 Claims, 3 Drawing Sheets

Fig. 3.
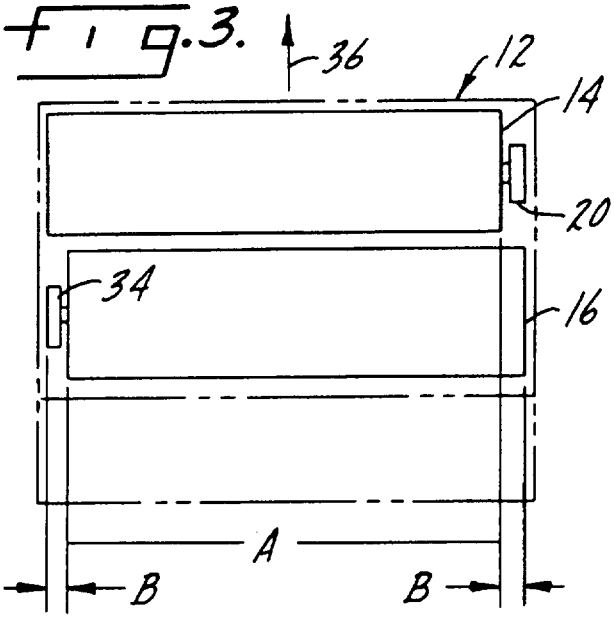
Fig. 4.
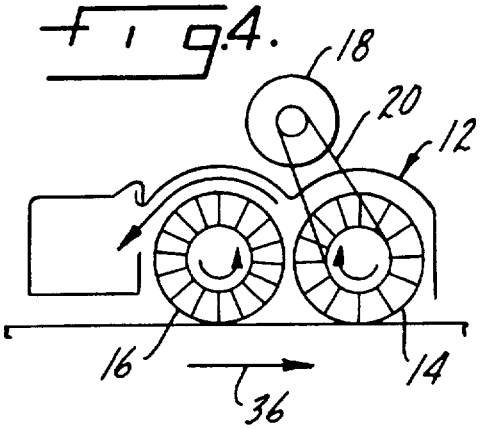
Fig. 5.
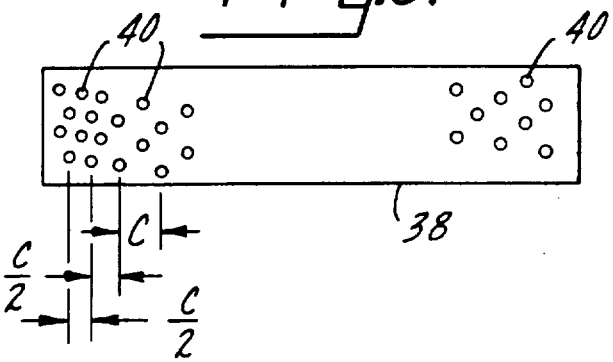
Fig. 6.
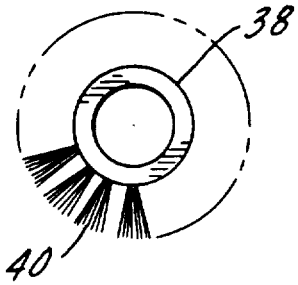
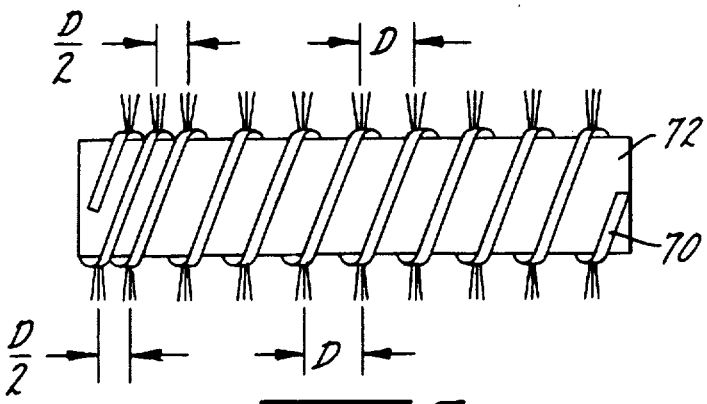
Fig. 7.
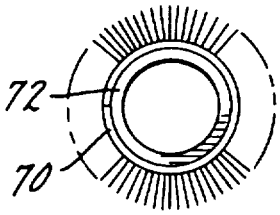
Fig. 8.

SCRUBBING MACHINE HAVING OFFSET CYLINDRICAL BRUSHES

BACKGROUND OF THE INVENTION

Floor scrubbing machines are widely used to clean the floors of industrial and commercial buildings. They range in size from a small model which may clean a path ranging from perhaps 15 inches up to 36 inches wide controlled by an operator walking behind it, to a large model cleaning a path as wide as five feet controlled by an operator riding on the machine. In general, these machines have a wheeled chassis which contains, in addition to power and traction drive means, a tank to hold clean scrubbing solution and a tank to hold soiled solution recovered by a vacuum squeegee system from the floor being scrubbed. A scrub head is attached to the chassis by an articulated linkage system, and may be located in front of, under or behind the chassis. The scrub head contains one or more rotating scrub brushes and means to power them. These brushes may be either flat disc brushes that rotate about vertical axes or they may be cylindrical brushes rotating about horizontal axes. Both systems have their advantages and disadvantages, and both are widely used.

We are concerned here with scrubbers that use two counter-rotating cylindrical brushes, which is a common construction in the industry. The brushes are set parallel to each other and are closely spaced, with their axes of rotation being horizontal and transverse to the longitudinal axis of the machine. A major advantage of this configuration is that the cylindrical brushes, while scrubbing the floor, act cooperatively to also sweep up small items of loose debris that may be on the floor being scrubbed and deposit them in a debris tray. They are thus prevented from getting into the vacuum squeegee, where debris items may lodge under the squeegee lip and hold it off the floor, thus causing water streaks. Disc brushes do not have this sweeping capability. A good description of a prior art scrubber using two cylindrical brushes may be found in U.S. Pat. No. 3,702,488.

Cylindrical brushes commonly have some sort of drive means on one end to rotate them. Hydraulic motors mounted in line with the brushes have been used for this, as described in the above referenced patent. As described there, the hydraulic motors may be at least partially inserted into the hollow cores of the brushes. However, the hydraulic supply lines require some space outside of the brushes, which limits how closely the surrounding scrub head housings can be fitted at that end of the brushes. This in turn limits how close to a wall the machine can scrub on that side of the scrub head.

Cylindrical brushes are also commonly powered with electric motors mounted on top of the scrub head which drive the brushes through chain or belt drives. These belts or chains also take a certain amount of space at one end of the brushes, so again the machine is limited as to how close to a wall it can scrub on that side of the scrub head.

Many of these prior art scrubbers have the drive means placed on the same end of both brushes so that their opposite ends, which may be termed the idler ends because they are supported by idler bearings, can be closely shrouded to allow one side of the scrub head to scrub close to a wall. However, the weight of these drive motors, located as it is on the same end of both brushes, requires that some counterbalancing means be provided to obtain an even weight distribution of the scrub head on the floor. Generally a spring system is employed. Whatever is used adds to the cost and complexity of the machine.

There is thus a need for a scrubber using two counter-rotating cylindrical brushes with their known advantages, but which in addition permit scrubbing as close to a wall on both sides of the scrub head as current cylindrical brush scrubbers can scrub only on the side of the scrub head which doesn't have the brush drives. A further advantage would be achieved if the weight of the scrub head could be inherently balanced from side to side, thus eliminating any need for a counterbalancing means.

SUMMARY OF THE INVENTION

The invention meets the above needs by applying two novel features. Two equal length brushes are used, as in prior art machines, but in contrast to prior art machines the drive means for one brush are located at one end of that brush while the drive means for the other brush are located at the opposite end of that brush. Then each brush with its associated drive means is offset axially far enough that the brush bristles on each brush's idler end extend out as far as the drive means of the other brush. Thus, in use the idler end bristles of the front brush scrub the strip of the floor that will pass under the drive means (belt, hydraulic lines or other) of the rear brush, and the idler end bristles of the rear brush scrub the strip of floor that has passed under the drive means of the front brush. The scrubbed path on the floor is as wide as the length of one brush plus the width of the drive means for one brush. This gives a little advantage over prior art machines, which scrub a path only as wide as the length of their brushes. The sides of the scrub head housing can be fitted closely to the idler ends of both brushes, allowing the machine to scrub close to a wall on either side. Further, by driving the two brushes from opposite ends, the two drive motors are located one at each side of the scrub head so their weight is balanced and there is no need for counterbalancing.

As mentioned above, prior art scrubbers of the type we are discussing scrub a path on the floor as wide as the length of their brushes. Both of their brushes scrub the entire width of the path, or length of the brushes. A scrubber using the present invention, however, will have both brushes scrubbing a path width equal to the length of a brush minus the width of one brush drive. The two segments of scrubbed path width under the two brush drives will each be scrubbed by only one brush. Conventional brushes, which have a uniform fill of bristles from one end to the other, have been used in a scrubber built according to the present invention. They perform adequately, but it has been observed that the scrubbed floor has a discernable appearance difference in the portions of the path that were scrubbed with only one brush as compared to the portion scrubbed with two brushes. This single brush scrubbing is done by the bristles near the idler ends of the brushes.

The situation can be relieved by making the portion of each brush next to its idler end substantially more aggressive than the rest of the brush. This can be accomplished in a number of ways. For example, in a cylindrical brush made in a conventional manner by setting bristle tufts in holes in a core tube, closer spacing of bristle tufts might be used in the section where greater aggressiveness is desired, or larger diameter tufts, or a more aggressive bristle material. In a cylindrical brush made by spirally wrapping a strip brush around a core tube the spiral might be wound more tightly at one end. Other methods are doubtlessly possible also. The chosen technique should be applied from the idler end of each brush for a distance equal to the width of a drive means. Such brushes used in a scrubber built according to the present invention give the scrubbed floor an essentially uniform appearance.

BRIEF DESCRIPTION OF THE DRAWINGS

FIG. 3 is a schematic sketch of the scrub head of FIG. 2 showing the offset relationship of the scrub brushes.

FIG. 4 is a schematic side view of the scrub head of FIG. 2.

FIG. 5 is a plan view of the core tube of a scrub brush having two degrees of aggressiveness.

FIG. 6 is an end view of a scrub brush built with the core tube of FIG. 5.

FIG. 7 is a schematic plan view of a cylindrical scrub brush having two degrees of aggressiveness that is made by winding a strip brush spirally around a core tube.

FIG. 8 is an end view of the cylindrical scrub brush shown in FIG. 7.

DETAILED DESCRIPTION OF THE DRAWINGS

Figure 1:
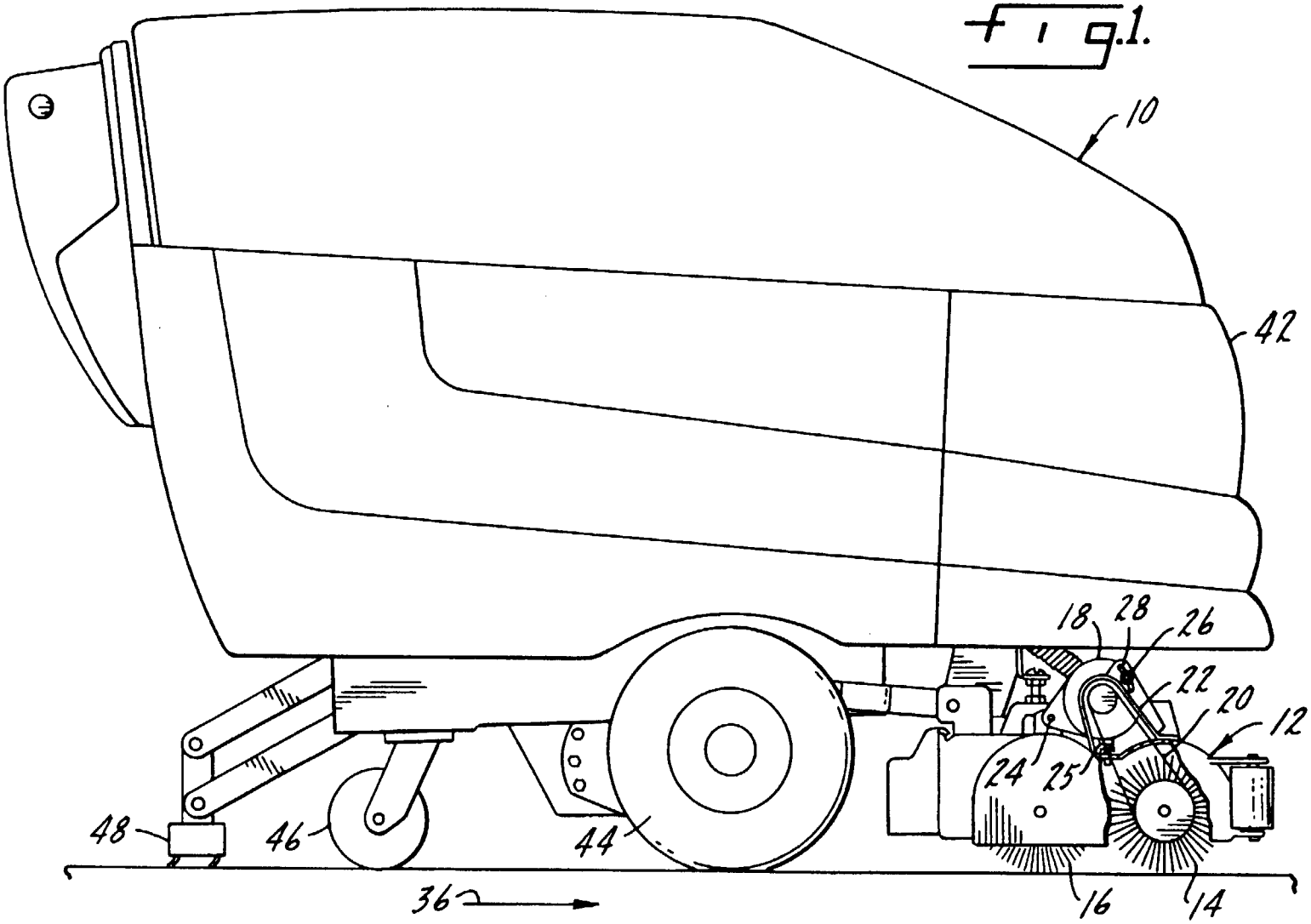
FIG. 1 is a side view of a floor scrubbing machine which uses the present invention.

A floor scrubbing machine 10 which uses the present invention is shown in FIG. 1. Its direction of travel while scrubbing is indicated by arrow 36. It is what is known as a walk behind scrubber, and for the most part will be recognized as quite conventional. The present invention is concerned with certain parts of the scrub head 12, which are the two rotatable scrub brushes, these being a front brush 14 and a rear brush 16, and related parts.

Each brush is rotated by an electric motor and a belt drive associated with that particular brush. Thus front brush 14 is rotated by motor 18 acting through belt 20. A belt guard 22 surrounds the belt for safety, and is attached to motor 18 with bolt 26 through slotted hole 28 in the belt guard. Motor 18 is conventionally mounted on the housing of the scrub head by a pivotable attachment 24. A jack screw 25 provides a means for setting the tension of the belt.

Figure 2:
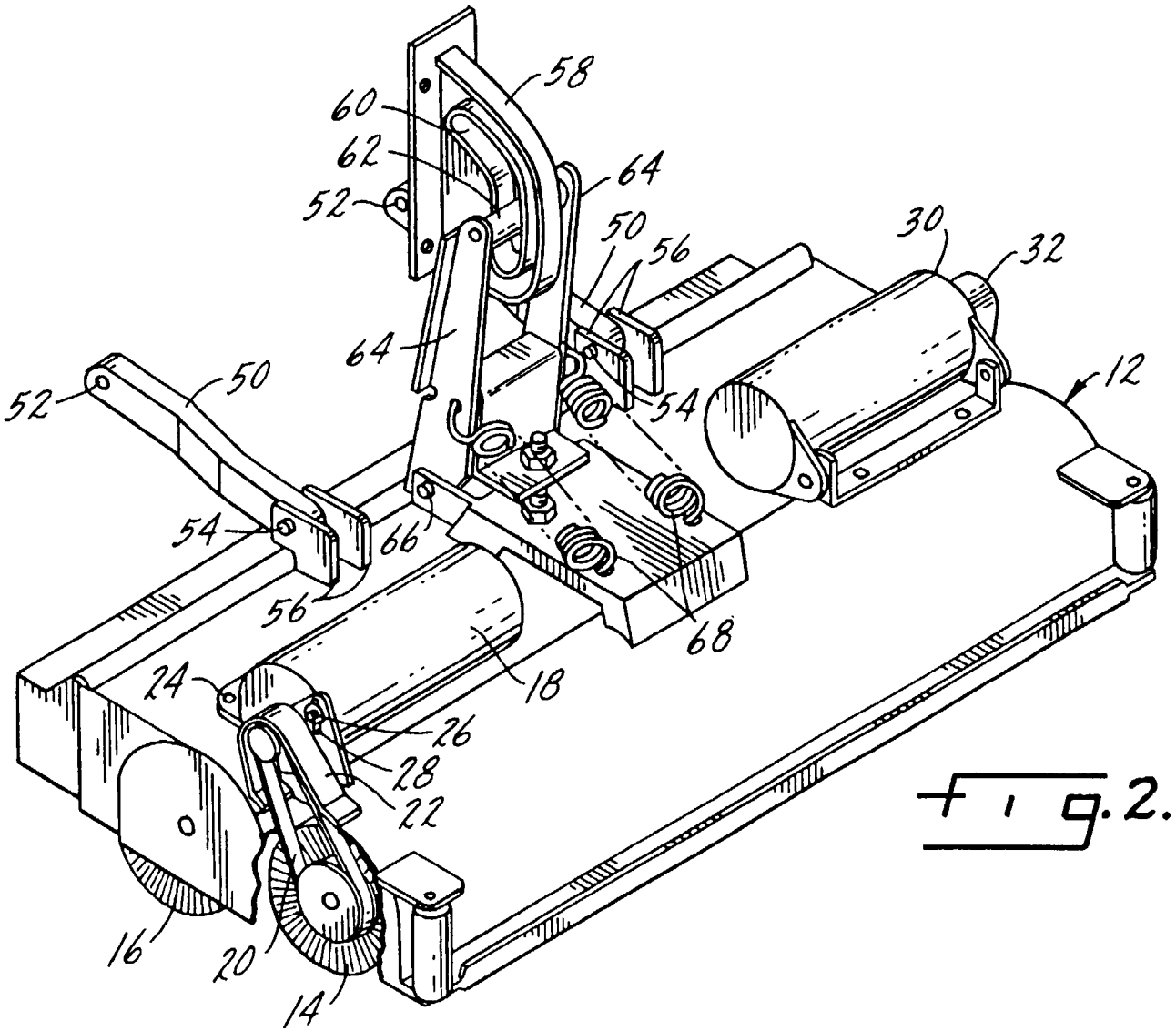
FIG. 2 is an isometric view of the scrub head of the floor scrubbing machine of FIG. 1, showing in clearer detail the arrangement of parts which are involved in the invention.

In a similar manner rear brush 16 is driven by motor 30, which is also mounted on the housing of the scrub head with the same kind of attachment as is used for motor 18. A belt guard 32, seen in FIG. 2, surrounds belt 34, not shown in FIGS. 1 or 2, but shown schematically in FIG. 3.

To complete the description of the floor scrubbing machine 10, it includes a chassis indicated generally at 42 which mounts the scrub head 12. The chassis is supported on front wheels 44 and rear wheels 46 and may include a vacuum squeegee 48 at the rear of the machine.

The scrub head 12 is mounted to the chassis 42 by an articulated linkage which includes a pair of spaced links 50, each of which will be pivotally mounted to the chassis at a pivot point 52 and will be pivotally mounted at the opposite end to the scrub head 12 by a pin 54 extending through mounting brackets 56. A guide member 58 will be fixed to the chassis 42 and has a guide slot 60 which has a portion which extends rearwardly and upwardly and a portion which extends generally vertically. There is a roller 62 movable within the guide slot 60 and the roller is rotatably mounted between a pair of arms 64 which are each pivotally mounted to the scrub head 12 as at 66. A pair of coil springs 68 each bias the scrub head in a generally upward direction, with the weight of the scrub head maintaining it on the floor. The described articulated linkage and spring arrangement is described in a copending application filed simultaneously herewith and is for the purpose of minimizing damage to the scrub head when it should contact an obstruction such as a wall. In effect, the linkage and springs serve to permit the scrub head to rise upon such contact so that the front wheels 44 will lift off of the floor and the kinetic energy of the impact will be absorbed by the springs 68 and the upward movement of the chassis, as well as by utilizing energy absorbent material for the housing of the floor scrubbing machine 10.

It will be noted that motors 18 and 30 are mounted on opposite sides of scrub head 12, thus providing an inherent weight balance for the scrub head without the need for any counterbalance system. This is an advantage over many prior art cylindrical brush scrubbers, on which both brush drive means have been at one side of the scrub head, necessitating some form of counterbalancing.

FIG. 3 shows schematically that the front brush 14 and the rear brush 16 are mounted in scrub head 12 in an offset relationship to each other. Thus the left end of front brush 14 is offset to the left of the left end of rear brush 16 by a distance shown as "B". Likewise the right end of rear brush 16 is offset to the right of the right end of front brush 14 by the same distance "B". This distance "B" is selected to equal the distance of the outer edge of drive belts 20 and 34 from their associated brushes. It is thus possible to locate both side walls of the scrub head close to a brush end. This permits scrubbing close along walls on either side of the machine, which is a significant advantage over prior art machines.

It will be noted in FIG. 3 that brushes 14 and 16 both scrub the floor for the width "A", but that the two narrow strips "B" are only scrubbed by one brush. If conventional brushes are used, which have a uniform bristle fill from end to end, there will be a discernible difference in appearance of the scrubbed floor between width "A" which is scrubbed with two brushes and strips "B" which are scrubbed by only one brush each. A variation in the construction of the brushes can overcome this. In FIGS. 5 and 6 a conventional core tube 38 is shown into which bristle tufts 40 have been set in a conventional manner by drilling holes in the tube and stapling bristle tufts into them. Conventional spacing is used for these bristle tufts, represented as dimension "C", except at one end, where a closer spacing of "C/2" is used. Bristle tufts are set at this closer spacing starting at one end of the brush and going in for a distance equal to dimension "B" in FIG. 3. When brushes made like this are used in the scrub head of the present invention the brush end with the more closely set tufts of bristles is installed as the end opposite to the drive related to that brush. The closer spacing of bristle tufts gives that end of the brush more aggressiveness or scrubbing ability than the rest of the brush, so even though the "B" strips are only scrubbed by one brush their appearance will be essentially the same as the "A" strip which is scrubbed by two brushes.

It will be realized that the purpose of this brush construction is to provide the brush with greater aggressiveness near one end, and that any construction which does that can be used. The above described technique is one effective method. Other approaches might also work, for example, using the standard tuft spacing throughout the brush but with larger diameter tufts or a more aggressive bristle material at one end. A strip brush wound spirally around a core tube with the spiral wound more tightly at one end is another possibility. FIG. 7 shows a schematic plan view of such a brush, where a strip brush 70 has been spirally wrapped around a core tube 72. It will be understood that strip brush 70 is a conventional strip brush having a continuous uniform fill of bristles throughout its length. Likewise core tube 72 is conventional, and the practice of winding a strip brush spirally around a core tube to make a cylindrical brush is conventional. However, it is novel in such brushes to increase the aggressiveness near one end for the purpose described in this invention. This may be done by reducing the spacing or lead of the spiral where greater aggressiveness is desired. Thus, as shown in FIG. 7, the lead for most of the brush length may typically be a distance "D", but near one end this may be reduced to a lesser distance such as, for example, "D/2". The resulting increased bristle density will increase the aggressiveness of the brush in this area as required by the invention. FIG. 8 shows an end view of a brush constructed as shown in FIG. 7. No doubt other constructions are also possible.

The invention has been described in terms of a relatively small walk-behind scrubber having its scrub head at its forward end. However, the invention is equally applicable to larger scrubbers and to scrubbers having their scrub heads under or behind their chassis, so long as those scrub heads use two parallel transverse cylindrical brushes.

We claim:

1. A cylindrical scrub brush for use in a floor scrubbing machine having two parallel, axially offset rotatable cylindrical scrub brushes, said brush having ends and of length, said cylindrical scrub brush having bristles, with the brush bristles having a generally uniform density throughout a substantial portion of the brush length, with said brush having a greater bristle density adjacent only one of said ends than said uniform density throughout said substantialy portion of the brush length.

2. The cylindrical scrub brush of claim 1 wherein said bristles are in spaced tufts, with the spacing between bristle tufts being closer together in that portion of the brush having the greater bristle density than said spacing between bristle tufts in said substantial portion of uniform density.

3. The cylindrical scrub brush of claim 1 wherein said brush includes a core tube, said bristles being positioned in a spiral pattern about said core tube, said spiral pattern being generally uniform throughout the substantial portion of said brush length, with said spiral pattern having turns closer together adjacent one of said ends and having a greater bristle density thereat.

4. In a floor scrubbing machine comprising a chassis, wheels supporting said chassis, a scrub head supported on said chassis, said scrub head mounting two rotatable cylindrical scrub brushes, each brush having a first end, a second end, and an axial length, said scrub brushes having generally parallel axes, with the first end of one brush extending axially beyond the first end of the other brush, and with the second end of the other brush extending axially beyond the second end of the one brush, whereby the combined scrub path of said brushes is greater than the axial length of either brush, a drive for said one brush located at its second end and a drive for said other brush located at its first end, each of said brushes having bristles, the first end of said one brush and said second end of said other brush having a greater bristle density than portions of said brushes which overlap each other.

5. The floor scrubbing machine of claim 4 characterized in that the drive for said one brush has an axial outer end, said axial outer end being generally coextensive with the second end of the other brush.

6. The floor scrubbing machine of claim 4 characterized in that the drive for said other brush has an axial outer end, said axial outer end of said other brush being generally coextensive with the first end of said one brush.

7. The floor scrubbing machine of claim 4 characterized in that each drive includes a drive motor, with said drive motors being mounted on said scrub head on opposite sides thereof.

8. The floor scrubbing machine of claim 7 characterized in that each of said scrub brushes has one end driven by said drive and the opposite end mounted in an idler bearing.

9. The floor scrubbing machine of claim 4 characterized in that the axial distance between the first end of the one brush and the first end of the other brush is equal to the axial distance between the second end of the one brush and the second end of the other brush.

10. The floor scrubbing machine of claim 4 characterized in that said greater bristle density is provided by having a greater number of bristles per unit area.

* * * * *